US009570044B2

(12) United States Patent
Fan

(10) Patent No.: US 9,570,044 B2
(45) Date of Patent: Feb. 14, 2017

(54) IMAGE ADJUSTING METHOD, LIGHT SOURCE MODULE AND ELECTRONIC DEVICE

(71) Applicant: HTC Corporation, Taoyuan County (TW)

(72) Inventor: Fu-Cheng Fan, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 14/144,563

(22) Filed: Dec. 31, 2013

(65) Prior Publication Data

US 2014/0333679 A1 Nov. 13, 2014

Related U.S. Application Data

(63) Continuation-in-part of application No. 13/890,262, filed on May 9, 2013, now Pat. No. 9,274,264.

(51) Int. Cl.
*G09G 5/10* (2006.01)
*G09G 3/34* (2006.01)

(52) U.S. Cl.
CPC ..... *G09G 5/10* (2013.01); *G09G 3/3406* (2013.01); *G09G 2320/0606* (2013.01); *G09G 2320/0626* (2013.01); *G09G 2320/0666* (2013.01)

(58) Field of Classification Search
CPC ..... H01L 2924/0002; H01L 25/075; H01L 25/0753; H01L 2924/00; H01L 33/50; H01L 33/502; G09G 5/10; G09G 3/406; G09G 2320/0606; G09G 2320/0626; G09G 2320/0666
See application file for complete search history.

(56) References Cited

U.S. PATENT DOCUMENTS 8,317,348 B2 11/2012 Yoo et al.
8,353,613 B2 1/2013 Choi et al.
8,558,782 B2 10/2013 You et al.
(Continued)

FOREIGN PATENT DOCUMENTS

TW 201342346 10/2013
TW 201510977 3/2015

OTHER PUBLICATIONS

Xie et al. ;"Wide Color Gamut Backlight for Liquid Crystal Displays Using Three-Band Phosphor-Converted White Light-Emitting Diodes"; Applied Physics Express; vol. 2; No. 2; Jan. 23, 2009; pp. 022401-1-022401-3.*
(Continued)

*Primary Examiner* — Steven Loke
*Assistant Examiner* — Juanita Rhodes
(74) *Attorney, Agent, or Firm* — Jianq Chyun IP Office

(57) ABSTRACT

An image adjusting method, a light source module, and an electronic device are provided. The image adjusting method includes the following steps. A first set of light source and a second set of light source of the light source module are driven independently by corresponding driving intensity respectively. An image display command is received. The driving intensity corresponding to the first set of light sources and the second set of light sources respectively are adjusted according to the image display command, wherein a gamut of the first set of light sources is wider than that of the second set of light sources, and luminous efficacy of the second set of light sources is higher than that of the first set of light sources.

17 Claims, 10 Drawing Sheets

(56) References Cited

U.S. PATENT DOCUMENTS

| | | | | |
|---|---|---|---|---|
| 2004/0178743 | A1* | 9/2004 | Miller | G09G 3/3225 315/169.3 |
| 2010/0097407 | A1* | 4/2010 | Zulch | G01J 3/504 345/690 |
| 2010/0123155 | A1 | 5/2010 | Pickett et al. | |
| 2011/0186811 | A1 | 8/2011 | Coe-Sullivan et al. | |
| 2011/0199787 | A1* | 8/2011 | Kim | G02B 6/0023 362/612 |
| 2012/0002132 | A1 | 1/2012 | Yamazaki et al. | |
| 2012/0113671 | A1* | 5/2012 | Sadasivan | C09D 11/101 362/602 |
| 2012/0113672 | A1 | 5/2012 | Dubrow et al. | |
| 2013/0050612 | A1 | 2/2013 | Hur et al. | |
| 2013/0335677 | A1 | 12/2013 | You | |

OTHER PUBLICATIONS

"Office Action of United States Counterpart Application", issued on Dec. 18, 2014, p. 1-p. 16.

"Notice of Allowance of Related U.S. Appl. No. 13/890,262," issued on Nov. 30, 2015, p. 1-p. 11.

* cited by examiner

IMAGE ADJUSTING METHOD, LIGHT SOURCE MODULE AND ELECTRONIC DEVICE

CROSS-REFERENCE TO RELATED APPLICATION

This application is a continuation-in-part application of and claims the priority benefit of a prior application Ser. No. 13/890,262, filed on May 9, 2013, now pending. The entirety of the above-mentioned patent application is hereby incorporated by reference herein and made a part of this specification.

BACKGROUND OF THE INVENTION

1. Field of the Invention

The invention generally relates to an image adjusting method, a light source module, and an electronic device, in particular, to an image adjusting method, a light source module, and an electronic device that may adjust luminance intensity of a light source.

2. Description of Related Art

Because liquid crystal display (LCD) devices go toward the development trend of high color saturation gradually in recent years, the product research of a wide gamut display device has been emphasized by those of the related domain. In general speaking, a light source of the wide gamut display device often adopts red light, green light, and blue light light-emitting diode (LED) chips accompanying with quantum dot components, such that images of display devices have wide gamut and high color saturation. However, comparing with a light source that adopts blue light LED chips accompanying with Yttrium Aluminum Garnet (YAG), luminous efficacy of the light source of the wide gamut display device is lower, such that products have higher power consumption and shorter product lifetime.

SUMMARY OF THE INVENTION

Accordingly, an image adjusting method is provided in an embodiment of the invention, and the image adjusting method may display high quality images and prolong lifetime of products.

A light source module is provided in an embodiment of the invention, and the light source module has high color saturation, high luminous efficacy, and long lifetime.

An electronic device is provided in an embodiment of the invention, and the electronic device has high color saturation and long lifetime.

An image adjusting method of an embodiment of the invention includes the following steps. A first set of light source and a second set of light source of the light source module are driven independently by corresponding driving intensity respectively. An image display command is received. The driving intensity corresponding to the first set of light sources and the second set of light sources respectively are adjusted according to the image display command, wherein a gamut of the first set of light sources is wider than that of the second set of light sources, and luminous efficacy of the second set of light sources is higher than that of the first set of light sources.

The light source module of an embodiment of the invention includes a first set of light sources, a second set of light sources, and a processor. A gamut of the first set of light sources is wider than that of the second set of light sources, and luminous efficacy of the second set of light sources is higher than that of the first set of light sources. The processor is electrically connected to the first set of light sources and the second set of light sources, and configured to adjust driving intensity corresponding to the first set of light sources and the second set of light sources respectively according to an image display command.

The electronic device of an embodiment of the invention includes a body and the light source module mentioned above. The light source module is configured in the body.

Based on the above, the image adjusting method, the light source module, and the electronic device of the embodiments of the invention may satisfy the wide gamut requirements of some images and increase luminous efficacy.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
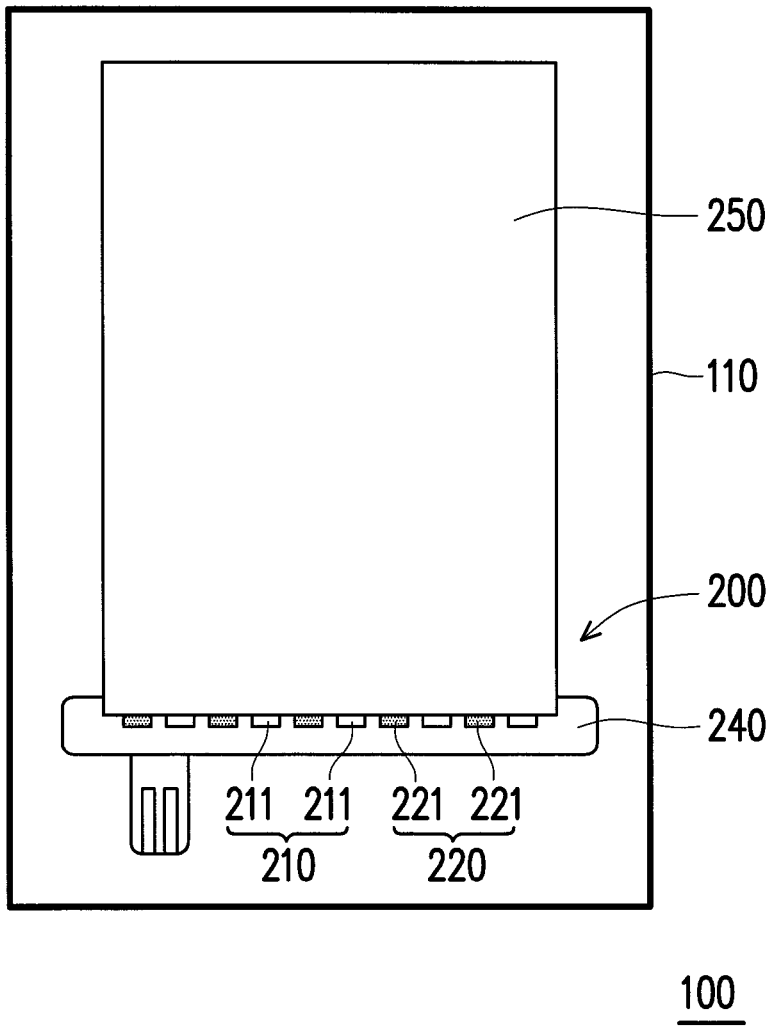
FIG. 1 is an architecture diagram of an electronic device of an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 2A:
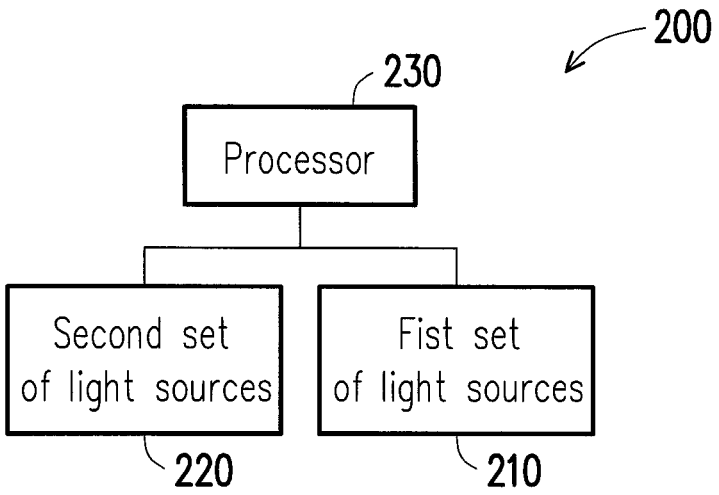
FIG. 2A is a block diagram of the light source module of FIG. 1.
Figure 2B:
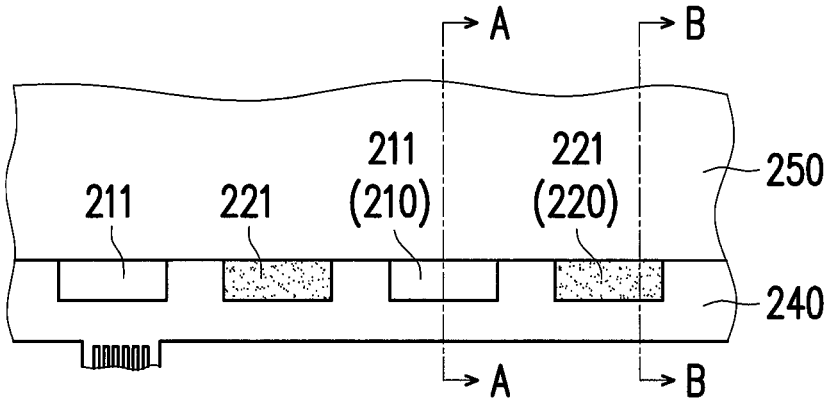
FIG. 2B is an architecture diagram of the light source module of FIG. 1.

FIG. 1 is an architecture diagram of an electronic device of an embodiment of the invention. FIG. 2A is a block diagram of the light source module of FIG. 1. FIG. 2B is an architecture diagram of the light source module of FIG. 1. Please referring to FIG. 1, an electronic device 100 includes a body 110 and a light source module 200. As shown in FIG. 2A, the light source module 200 is disposed in the body 110 in the embodiment. The light source module 200 includes a first set of light sources 210, a second set of light sources 220, and a processor 230, wherein the gamut of the first set of light sources 210 is wider than that of the second set of light sources 220, and luminous efficacy of the second set of light sources 220 is higher than that of the first set of light sources 210.

For instance, as shown in FIG. 2B, the first set of light sources 210 includes a plurality of first white light LEDs 211, and the second set of light sources 220 includes a plurality of second white light LEDs 221. In the embodiment, the first white light LED 211 includes a plurality of blue light diodes, red light conversion mediums, and green light conversion mediums, and the second white light LED 221 includes a plurality of blue light diodes and yellow light conversion mediums. For instance, each first white light LED 211 may be blue light LED chips covered with red light phosphors and green light phosphors respectively to provide white lights, or each first white light LED 211 may also be red light and blue light LED chips covered with green light phosphors thereof. In other words, each first white light LED 211 may be composed of including the red light phosphors, the green light phosphors, and the blue light LED chips, or composed of including the red light LED chips, the green light phosphors, and the blue light LED chips. On the other hand, each second white light LED 221 includes a YAG and a blue light LED chip, and provides a white light different form that of the gamut of the first white light LED 211 and has higher luminous efficacy. In other words, in the embodiment, each first white light LED 211 serves to provide a white light that has wide gamut and high color saturation, and the second white light LED 221 has good luminous efficacy and may prolong the lifetime of products.

Figure 2C:
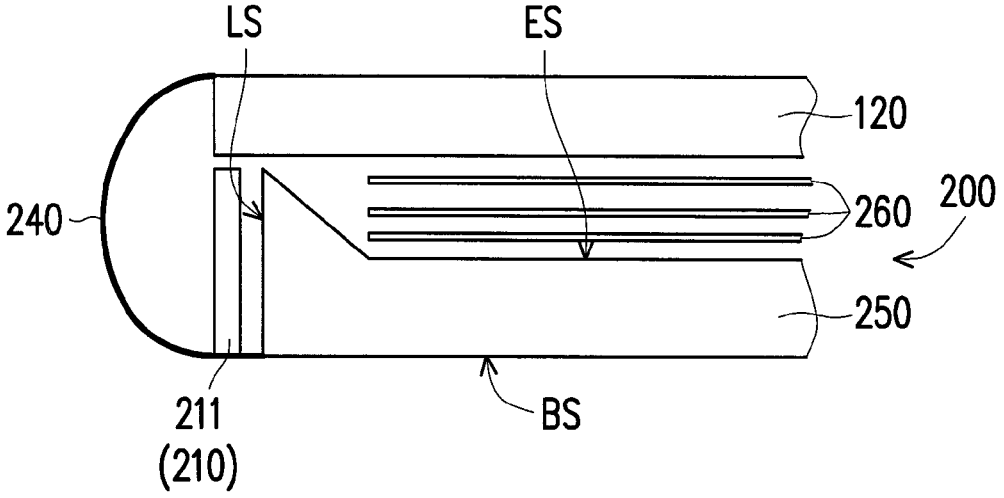
FIG. 2C is a cross-sectional view of the electronic device of FIG. 1 taken along line A-A.
Figure 2D:
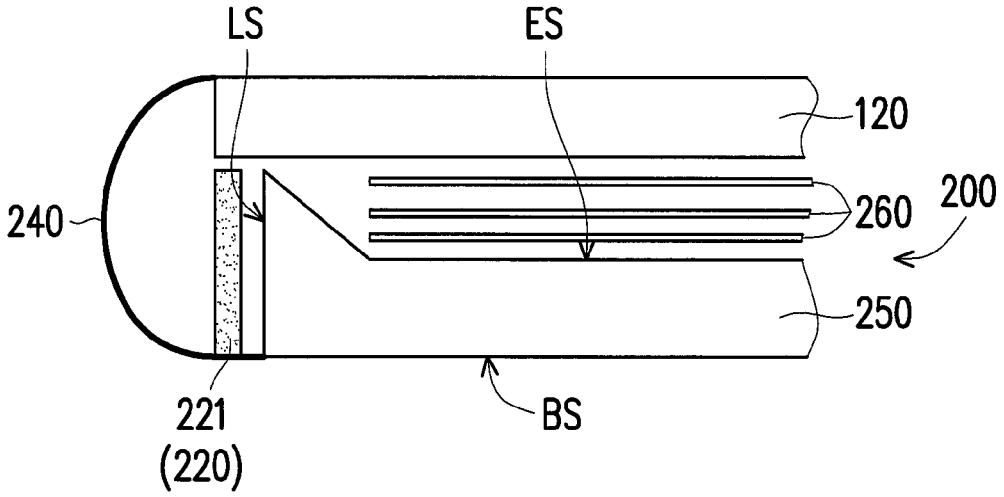
FIG. 2D is a cross-sectional view of the electronic device of FIG. 1 taken along line B-B.

FIG. 2C is a cross-sectional view of the electronic device of FIG. 1 taken along line A-A. FIG. 2D is a cross-sectional view of the electronic device of FIG. 1 taken along line B-B. For details, in the embodiment, the light source module 200 further includes a flexible printed circuit board (PCB) 240 and a light guide plate 250, and the electronic device 100 further includes a display panel 120. Please referring to FIG. 2B to FIG. 2D, the light guide plate 250 has a light-incident side LS, and the first white light LEDs 211 and the second white light LEDs 221 are arranged interlacing with each other on the flexible printed circuit board 240 and located on the light-incident side LS (as shown in FIG. 2B). When the first white light LED 211 and the second white light LED 221 emit lights, the lights provided thereof may enter the light guide plate 250 form the light-incident side LS and proceed with a total reflection mode inside the light guide plate 250. On the other hand, the bottom surface BS of the light guide plate 250 may also have a light scattering micro-structure (not illustrated) which serves to destroy the phenomenon of the total reflection, such that the lights leave the light guide plate 250 through a light-emitting surface ES.

Besides, in the embodiment, the light source module 200 further includes at least one optical film 260 which is located on a transmitting path of the lights and located between the light guide plate 250 and the display panel 120. For instance, in the embodiment, the optical film 260 may include a prism sheet, a diffuser, and at least one of the other optical films, but the invention is not limited thereto. The prism sheet has a function of light collimation, which may effectively increase the forward luminance of the light source module 200, and therefore provides a surface light source with high luminance to the display panel 120.

Besides, please referring to FIG. 2A again, the processor 230 is electrically connected to the first set of light sources 210 and the second set of light sources 220 in the embodiment, and configured to change luminance intensity of the first set of light sources 210 and the second set of light sources 220 according to an image display command. In other words, the white lights emitted by the first white light LEDs 211 and the second white light LEDs 221 are mixed in the light guide plate 250 after entering the light guide plate 250 through the light-incident side LS, and the white lights with different gamut may be further provided to the display panel 120 according to different image modes so as to satisfy the requirements of wide gamut and high color saturation of different images and maintain lifetime of products.

Figure 3:
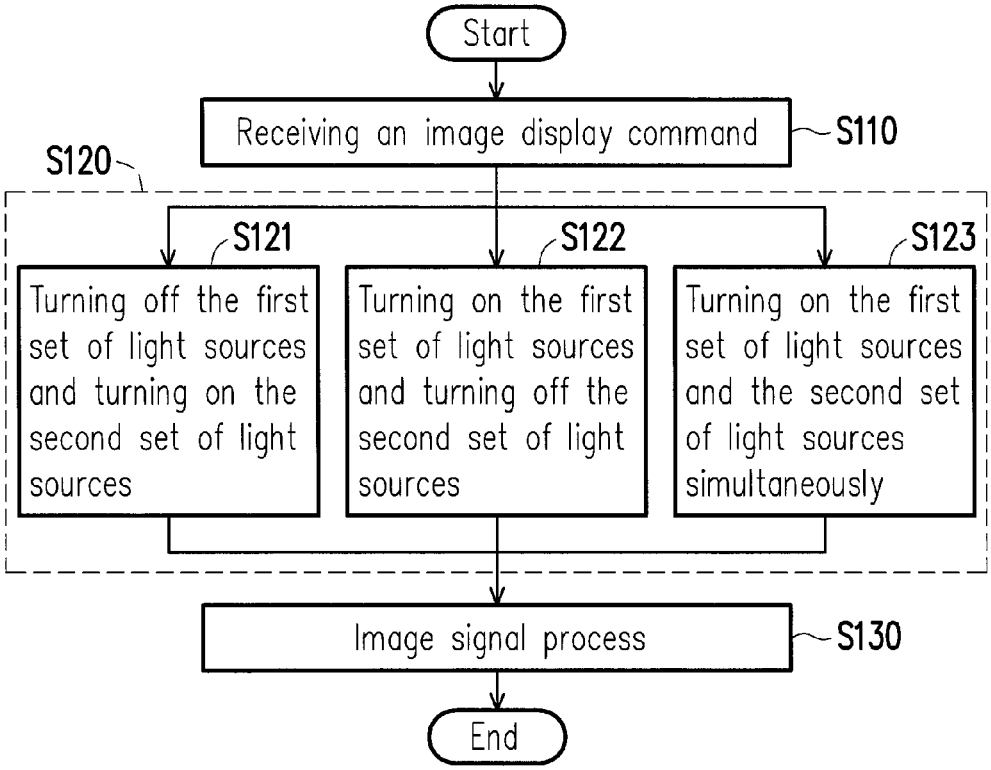
FIG. 3 is a flowchart of an image adjusting method of an embodiment of the invention.

The details of the steps of an image adjusting method accompanied with FIG. 3 are described in detail below.

FIG. 3 is a flowchart of an image adjusting method of an embodiment of the invention. Please referring to FIG. 3, in the embodiment, for instance, the image adjusting method may be performed through the processor 230 of the electronic device 100 in FIG. 2A, but the invention is not limited thereto. The image adjusting method of the embodiment includes the following steps. First, users may select an image mode according to an actual requirement, and driving independently a first set of light sources 210 and a second set of light source 220 of a light source module 200 by the corresponding driving intensity respectively. Then step S110, receiving an image command, is performed. After that, step S120 which changes and adjusts the driving intensity corresponding to the first set of light sources 210 and the second set of light sources 220 respectively according to the image display command is performed. Therein gamut of the first set of light sources 210 is wider than that of the second set of light sources 220, and luminous efficacy of the second set of light sources 220 is higher than that of the first set of light sources 210.

In the image adjusting method of the embodiment, the method for selecting the image mode further includes: determining a display situation; and determining a light emitting performance corresponding to the light source modules 210 and 220 according to the display situation, wherein the light emitting performance includes at least one of the output power, luminous efficacy, and gamut of the light source modules 210 and 220. Under different image modes, the processor 230 may determine a power ratio according to the light emitting performance, wherein the power ratio is the ratio of the output intensity of the first set of light sources 210 versus that of the second set of light sources 220, and adjusts the ratio of the driving intensity corresponding to the first set of light sources 210 and the second set of light sources 220 respectively according to the power ratio. In more details, the display situation may include a high efficiency mode and a wide gamut mode, the power ratio is decreased when the high efficiency mode is determined, and the power ratio is increased when the wide gamut is determined. For instance, in the embodiment, different image modes may be defined in advance respectively according to the different image function requirements. For example, higher color saturation of the image is required while reviewing pictures on the electronic device 100; however, it may not be required while reviewing videos and audios, so luminous efficacy of the set of light sources may be increased appropriately to avoid high power consumption.

Further, step S120 includes sub-steps S121, S122, and S123 as shown in FIG. 3.

In step 120, the processor 230 may perform step S121 or step S122 according to the image display command, that turns off one of the first set of light sources 210 and the second set of light sources 220 and turns on only the other of the first set of light sources 210 and the second set of light sources 220, for instance, turning off the first set of light sources 210 and only turning on the second set of light sources 220 (as shown in step S121), or turning on the first set of light sources 210 and only turning off the second set of light sources 220 (as shown in step S122). Or step S123 that turns on the first set of light sources 210 and the second set of light sources 220 simultaneously and adjusts the ratio of the driving intensity corresponding to the first set of light sources 210 and the second set of light sources 220 respectively is performed. In the embodiment, for instance, the method that the processor 230 adjusts the ratio of the driving intensity corresponding to the first set of light sources 210 and the second set of light sources 220 respectively is to control the magnitudes of the currents flowing through different sets of light sources, such that the effect for adjusting the driving intensity corresponding to the first set of light sources 210 and the second set of light sources 220 respectively may be achieved.

Figure 4:
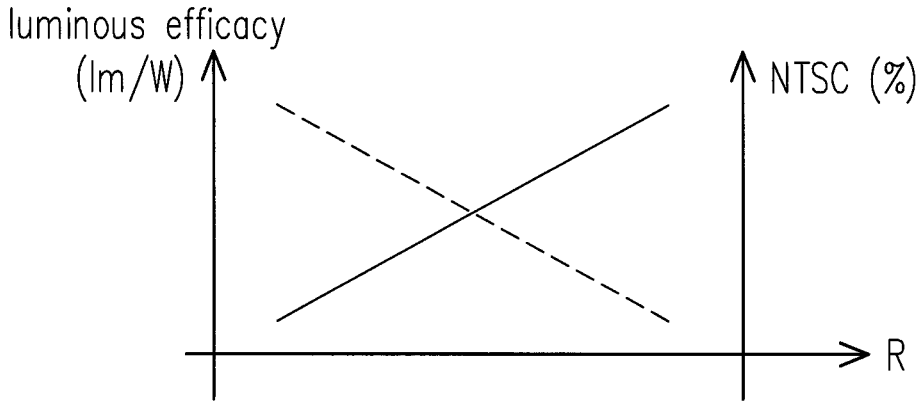
FIG. 4 is a relationship diagram illustrating the relationship among luminous efficacy of the light source module, color saturation of the light source module, and a ratio of the currents flowing through different sets of light sources.

FIG. 4 is a relationship diagram illustrating the relationship among luminous efficacy of the light source module, color saturation of the light source module, and the ratio of the currents flowing through different sets of light sources of FIG. 2A. Please referring to FIG. 2A and FIG. 4, for instance, the magnitudes of the currents flowing through the first set of light sources 210 and the second set of light sources 220 may be listed as shown in Table 1. However, the invention is not limited thereto; it will be apparent to those skilled in the art that appropriate modifications and variations can be made to the parameters and configurations thereof, but they still fall within the scope of the invention.

TABLE 1

| | magnitudes of currents (mA) | | | | |
|---|---|---|---|---|---|
| First set of light sources 210 | 0 | 5 | 10 | 15 | 20 |
| Second set of light sources 220 | 20 | 15 | 10 | 5 | 0 |
| Current ratio R | 0 | 0.33 | 0.5 | 3 | infinity |

In Table 1, for instance, the sum of the magnitudes of the currents of the first set of light sources 210 and the second set of light sources 220 is 20 mA, but the magnitude of the current flowing through the first set of light sources 210 is different from that flowing through the second set of light sources 220, so the light source module 200 may also have different luminous efficacy and different color saturation. Please referring to Table 1 and FIG. 4, in the embodiment, the definition of the current ratio R is the ratio of the magnitude of the current flowing through the first set of light sources 210 and that flowing through the second set of light sources 220; in other words, when the current ratio is larger, it indicates that the magnitude of the current flowing through the first set of light sources 210 is larger than that flowing through the second set of light sources 220. Therefore, luminous efficacy of the light source module 200 is increased (as the solid line illustrated in FIG. 4), but color saturation will be decreased (as the dotted line illustrated in FIG. 4). By contrast, when the current ratio is smaller, luminous efficacy of the light source module 200 is decreased, but color saturation may be increased. Therefore, users may define the image modes according to the actual requirement and adjust the driving intensity corresponding to the first set of light sources 210 and the second set of light sources 220 respectively under different image modes so as to give consideration to the image display performance and luminous efficacy of the light source module 200.

Then please referring to FIG. 3 again, step S130, which changes a gamma curve of the display panel 120 that adopts the light source module 220 as the light source according to the image display command, is performed. For instance, when the magnitude of the current flowing through the second set of light sources 220 is larger, the electronic device 100 may provide images with high color saturation. In this mode, gamma curves of images displayed by the display panel 120 may be adjusted and a corresponding image signal process is performed though the processor 230, such that the skin color recognized by people or the specific color may be returned to the gamut of the memory color of the system definition. Thus, the effect for increasing saturation of pixel color of the image may be achieved, and the skin color recognized by people or specific color may also be maintained as a natural profile simultaneously.

Besides, although the first white light LED 211 and the second white light LED 221 of the embodiment mentioned above are packaged into different light-emitting components as an example, but the invention is not limited thereto. In another embodiment, the first white light LED 211 and the second white light LED 221 may also be packaged into the same light-emitting component LE (as shown in FIG. 5), the below accompanied with FIG. 5 are described in detail.

Figure 5:
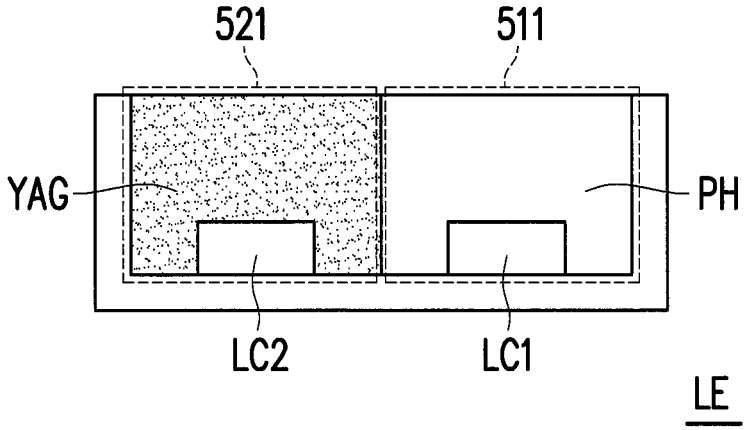
FIG. 5 is a cross-sectional view of a light-emitting component of the light source module of FIG. 2A.

FIG. 5 is a cross-sectional view of a light-emitting component of the light source module of FIG. 2A. Please refer to FIG. 5, each of the first white light LEDs 511 of the first set of light sources 210 and one of the second white light LEDs 521 of the second set of the light sources 220 of the embodiment may be packaged into a light-emitting component LE. In the embodiment, for example, the first white light LED 511 is a LED chip LC1 which is covered with a phosphor PH. For instance, when the LED chip LC1 is a blue light LED chip, the phosphor PH may be a red light phosphor and a green light phosphor, and when the LED chip LC1 is a red light LED chip and a blue light LED chip, the phosphor PH is a green light phosphor. On the other hand, the second white light LED 521 includes a YAG and a LED chip LC2, wherein the LED chip LC2 is a blue light LED chip. Therefore, the second white light LED 521 may provides a white light different from that of gamut of the first white light LED 511 and has higher luminous efficacy. When the light-emitting component LE is applied to the light source module 200, the driving intensity corresponding to the first set of light sources 210 and the second set of light sources 220 respectively may also be adjusted through the processor 230 under different image modes, such that the light source module 200 and the electronic device 100 achieve the performance and the advantage mentioned above, no further description is given hereinafter.

Besides, although the first white light LED 211 of the embodiment mentioned above adopts different LED chips accompanied with the usage of different phosphor materials as an example, but the invention is not limited thereto. In the other embodiments, the first white light LED 211 may also adopt LED chips accompanied with the usage of different phosphor materials or quantum dot components. The below accompanied with FIG. 6A and FIG. 6B are described in detail.

Figure 6A:
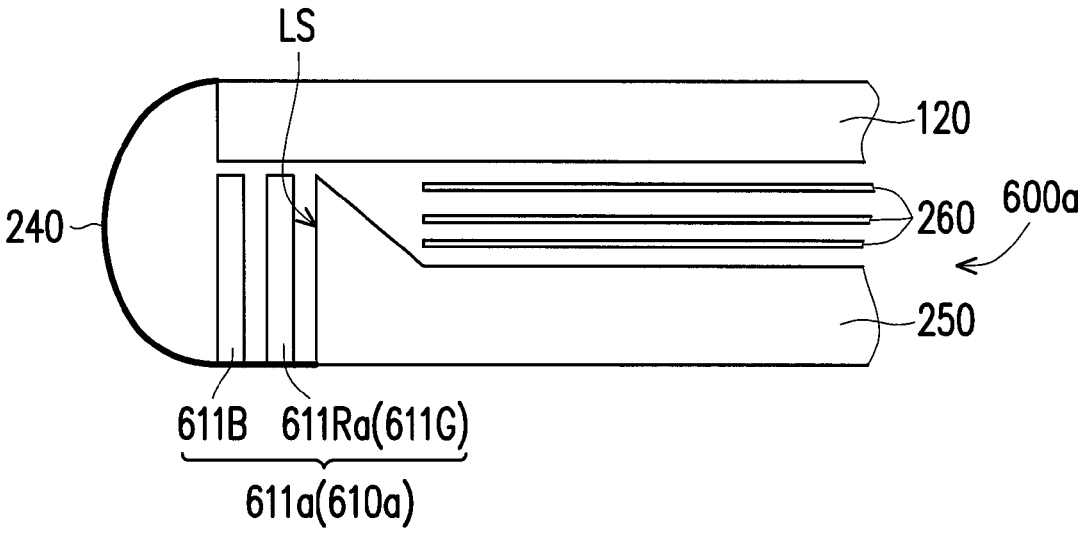
FIG. 6A and FIG. 6B are cross-section views of the different light source modules of FIG. 1.
Figure 6B:
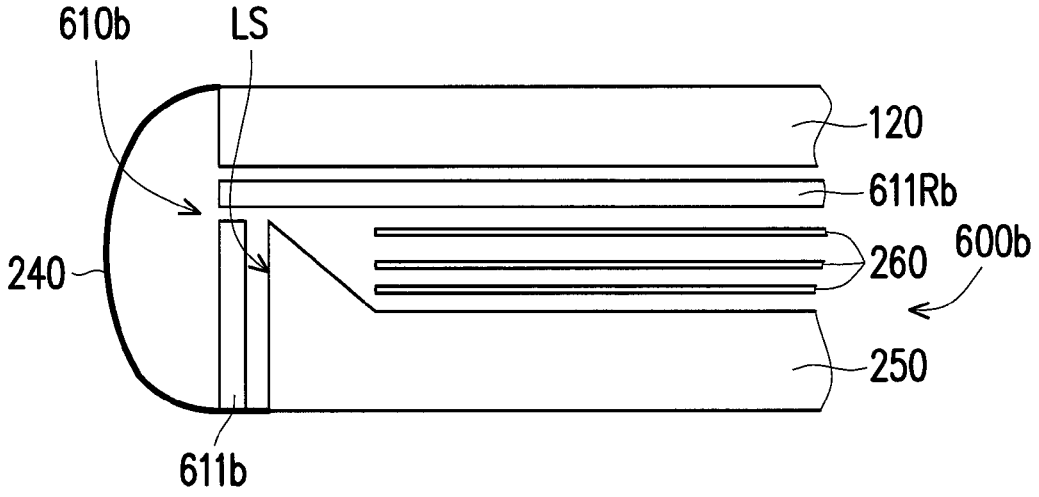

FIG. 6A and FIG. 6B are cross-section views of the different light source modules of FIG. 1. Please referring to FIG. 6A and FIG. 6B, the light source modules 600*a* and 600*b* is similar to the light source module 200 of FIG. 1, and the difference is described as below. In the embodiment of FIG. 6A, the light source module 600*a* further includes a red light quantum dot component 611Ra and a green light quantum dot component 611G, and for example, each of the first white light LEDs 611*a* of the first light source 610*a* is a blue light LED chip. For instance, in the embodiment, the red light quantum dot component 611Ra and the green light quantum dot component 611G such as quantum dot phosphor materials may be packaged into glass and located between the blue light LED chip 611B and the light-incident side LS of the light guide plate 250. In other words, the red light quantum dot component 611Ra and the green light quantum dot component 611G are located on a light transmitting path provided by the blue light LED chip 611B, such that they are configured to provide a white light with wide gamut and high color saturation to the display panel 120. Thus, when the first white light LED 611*a* is applied to the light source module 600*a*, the light source module 600*a* may also adjust the driving intensity corresponding to the first set of light sources 610*a* and the second set of light sources 220 respectively through the processor 230 under different image modes, such that the light source module 600*a* achieves the performance and the advantage similar to those of the light source module 200, no further description is given hereinafter.

On the other hand, in the embodiment of FIG. 6B, for example, each of the first white light LEDs 611*b* of the first set of light sources 610*b* is a blue light LED chip which is covered with a green light phosphor, and the first set of light sources 610*b* of the light source module 600 further includes a red light quantum dot component 611Rb. In the embodiment, for example, the red light quantum dot component 611Rb is a red light quantum dot film and is located between the light guide plate 250 and the display panel 120. When the blue light LED chip emits the lights, the lights pass through the green light phosphor first and parts of the lights are transferred to the green lights. Then, the lights are transmitted to the red light quantum dot component 611Rb through the light guide plate 250 and parts of the lights are transferred to red lights, such that white lights with wide gamut and high color saturation are constructed further, and then transmitted to the display panel 120.

Besides, in the embodiment of FIG. 6B, the lights emitted by the second white light LED 221 may also pass the red light quantum dot component 611Rb. Concurrently with performing the aforementioned step S130 to change the gamma curve of the display panel 120, color saturation of the red lights may also be adjusted selectively, such that the pixel color of the image display is maintained naturally. Thus, when the first white light LED 611*b* is applied to the light source module 600*b*, the light source module 600*b* may also adjust the driving intensity corresponding to the first set of light sources 610*b* and the second set of light sources 220 respectively through the processor 230 under different image modes, such that the light source module 600*b* achieves the performance and the advantage similar to those of the light source module 200, no further description is given hereinafter.

Continuing the above, the light source modules 600*a* and 600*b* may adjust the driving intensity corresponding to the first set of light sources 210 and the second set of light sources 220 respectively through the processor 230 under different image modes, so they may also be applied to the electronic device 100 of FIG. 1, such that the electronic device 100 may achieve the similar performance and advantage, no further description is given hereinafter.

Figure 7:
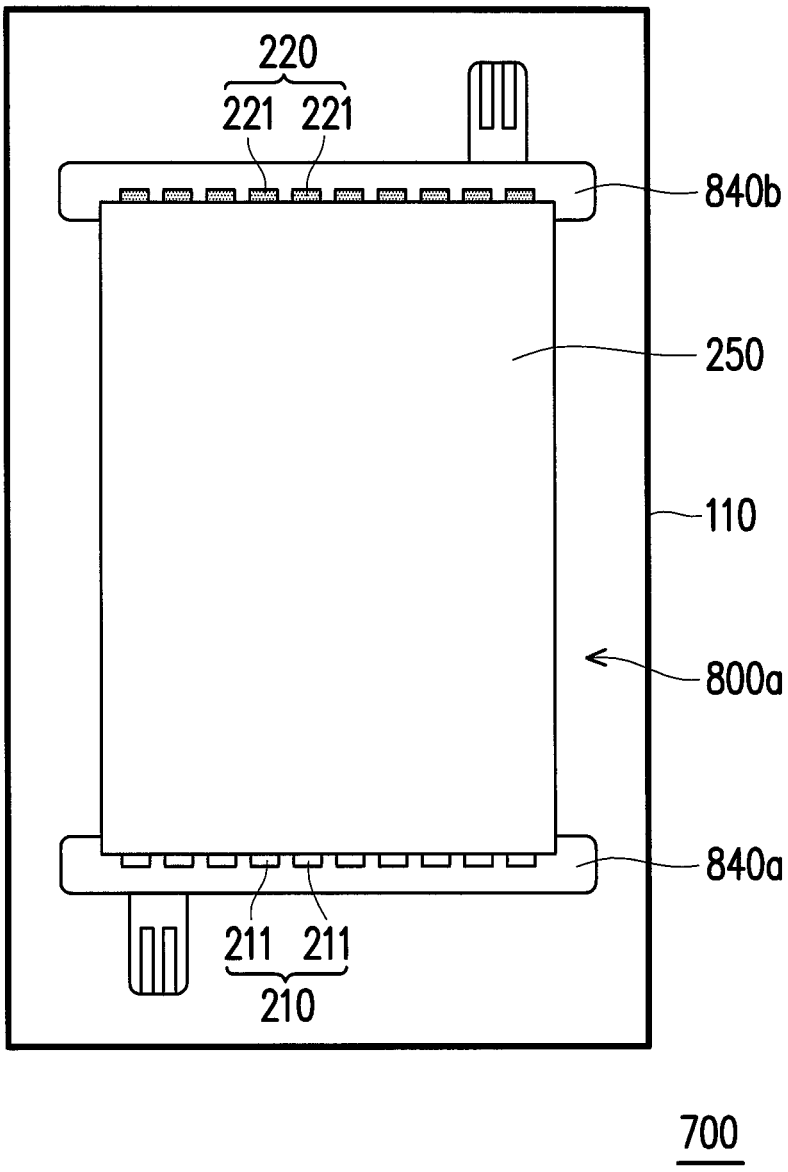
FIG. 7 is an architecture diagram of an electronic device of another embodiment of the invention.
Figure 8A:
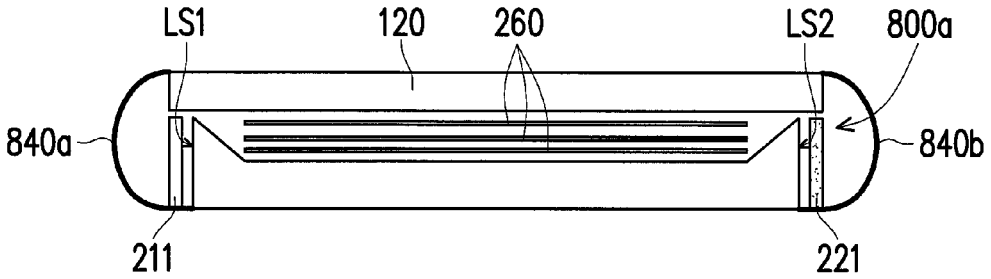
FIG. 8A to FIG. 8C are cross-section views of the different light source modules of FIG. 7.
Figure 8B:
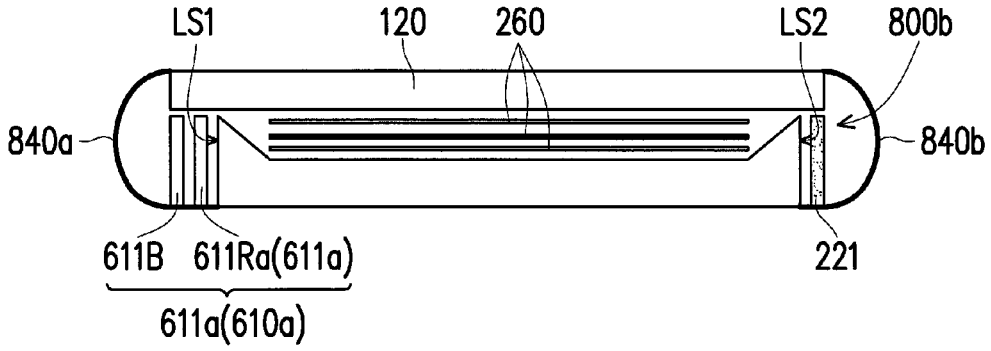
Figure 8C:
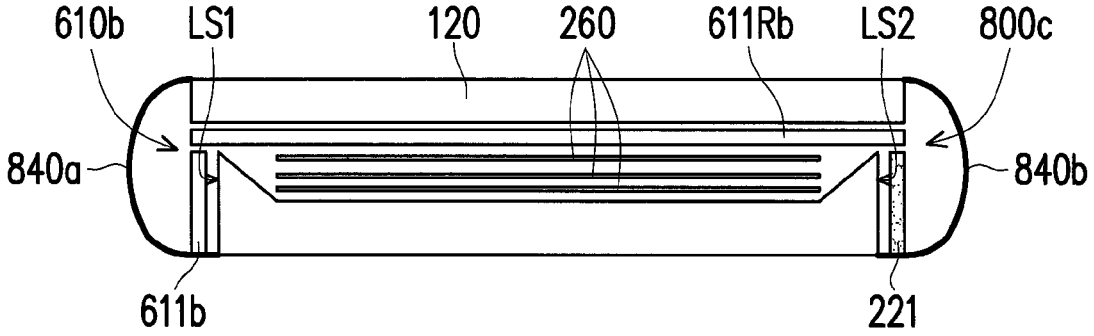

FIG. 7 is an architecture diagram of an electronic device of another embodiment of the invention. FIG. 8A to FIG. 8C are cross-section views of the different light source modules of FIG. 7. Please referring to FIG. 7 and FIG. 8A to FIG. 8C, the electronic device 700 is similar to the electronic device 100 of FIG. 1, the light source modules 800*a*, 800*b*, and 800*c* are similar to the light source module 200 of FIG. 1, and the difference is described as below. Please referring to FIG. 7 and FIG. 8A first, in the embodiment, the light source module 800*a* further includes a first flexible printed circuit board 840*a*, a second flexible printed circuit board 840*b*, and a light guide plate 250, wherein the light guide plate 250 has a first light-incident side LS1 and a second light-incident side LS2 relative to each other.

As shown in FIG. 7, the first white light LED 211 of the aforementioned embodiment is arranged on the first flexible printed circuit board 840*a* and located on the first light-incident side LS1, and the second white light LED 221 is arranged on the second flexible printed circuit board 840*b* and located on the second light-incident side LS2. When the first white light LED 211 and the second white light LED 221 emit lights, the white lights emitted thereof may enter the light guide plate 250 through the first light-incident side LS1 and the second light-incident side LS2 respectively, and are mixed in the light guide plate 250, such that white lights with different gamut may be provided to the display panel 120 further according to different image modes.

As shown in FIG. 8A, in the embodiment, the material combinations of the first white light LED 211 and the second white light LED 221 of the light source module 800*a* are the same as those of the light source module 200 of FIG. 2B, and may construct a structure that is similar to the function of the light source module 200. On the other hand, in the embodiment as shown in FIG. 8B, the material combinations of the first white light LED 611*a* and the second white light LED 221 of the light source module 800*b* are the same as those of the light source module 600*a* of FIG. 6A, and may construct a structure that is similar to the function of the light source module 600*a*. In the embodiment as shown in FIG. 8C, the material combinations of the first white light LED 611*b* and the second white light LED 221 of the light source module 800*c* are the same as those of the light source module 600*b* of FIG. 6B, and may construct a structure that is similar to the function of the light source module 600*b*. The light source module 800*b* as shown in FIG. 8B and the light source module 800*c* as shown in FIG. 8C may both serve to replace the light source module 800*a* as shown in FIG. 8A. The light source modules 800*a*, 800*b*, and 800*c* may all adjust the driving intensity corresponding to the first set of light sources 210 (or 610*a*, 610*b*) and the second set of light sources 220 respectively through the processor 230 under different image modes, such that the light source modules 800*a*, 800*b*, 800*c*, and the electronic device 700 may achieve the similar performance and advantage of the aforementioned light source modules 200, 600*a*, 600*b*, and the electronic device 100, no further description is given hereinafter.

Figure 9:
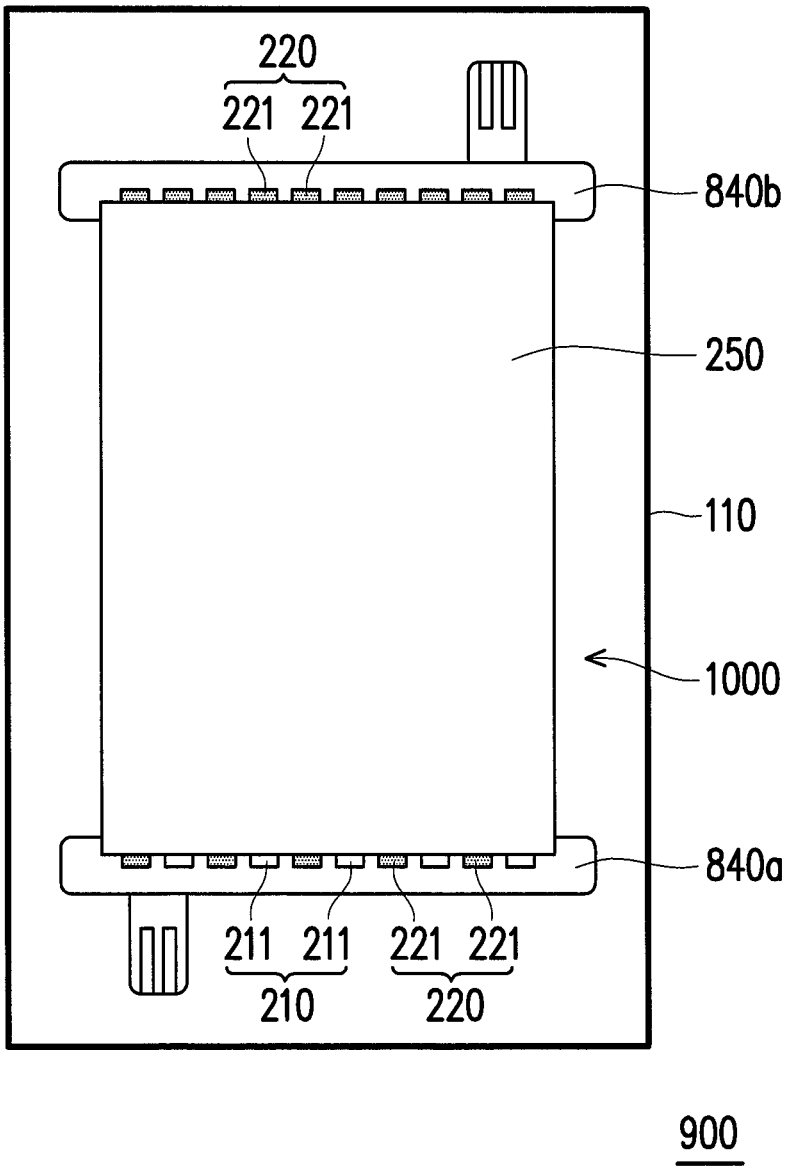
FIG. 9 is an architecture diagram of an electronic device of yet another embodiment of the invention.

FIG. 9 is an architecture diagram of an electronic device of yet another embodiment of the invention. Please referring to FIG. 9, the electronic device 900 is similar to the electronic device 700 of FIG. 7, and the difference is described as below. The first white light LED 211 of the light source module 1000 of the electronic device 900 and parts of the second LED 211 are arranged interlacing with each other on the first flexible printed circuit board 840*a* and located on the first light-incident side LS1, and the others of the second white light LED 221 are arranged on the second flexible printed circuit board 840*b* and located on the second light-incident side LS2. Therefore, when the first white light LED 211 and the second white light LED 221 emit lights, the white lights emitted thereof may enter the light guide plate 250 through the first light-incident side LS1 and the second light-incident side LS2 respectively, and are mixed in the light guide plate 250, such that white lights with different gamut may be provided to the display panel 120 further according to different image modes.

In other words, the light source module 1000 may also adjust the driving intensity corresponding to the first set of light sources 210 and the second set of light sources 220 respectively through the processor 230 under different image modes, such that the light source module 1000 and the electronic device 700 achieve the performance and the advantage similar to those of the aforementioned light source module 200 and the electronic device 100, no further description is given hereinafter. Besides, the light source module 1000 may also adopt the first white light LEDs 611*a* and 611*b*, construct structures that are similar to the aforementioned light source modules 800*b* and 800*c* respectively, and have the performance and the advantage similar to those of the aforementioned light source modules 800*b* and 800*c*, no further description is given hereinafter.

Besides, although the second white light LED 221 of the aforementioned embodiment adopts the blue light LED chip accompanied with the usage of the YAG as an example, but the invention is not limited thereto. In other embodiments, the second white light LED 221 may also be a blue light LED chip which is covered with a red light phosphor and a green light phosphor respectively, and the architecture of the first white light LED accompanied is, for example: a red light LED chip and a blue light LED chip which are covered with a green light phosphor; a blue light LED chip accompanying with a red light quantum dot component and a green light quantum dot component; or a blue light LED chip which is covered with a green light phosphor accompanying with a red light quantum dot component. Therefore, the structures similar to the light source modules 200, 600*a*, 600*b*, 800*a*, 800*b*, 800*c*, and 1000 are constructed, and the performances and the advantages similar to those of the light source modules 200, 600*a*, 600*b*, 800*a*, 800*b*, 800*c*, and 1000 mentioned above are achieved, no further description is given hereinafter.

Besides, it should be mentioned that luminous efficacy and the gamut of the first set of light sources 210, 610*a* are relative to those of the second set of light sources 220. For example, when the first set of light sources 610*a* includes multiple blue light diodes, red light conversion mediums, and green light conversion mediums, and the second set of light sources 220 includes multiple blue light diodes and yellow light conversion mediums, luminous efficacy of the second set of light sources 220 adopting yellow light conversion mediums is higher, but gamut thereof is smaller. However, when the first set of light sources 610*a* and the second set of light sources 220 both adopt read light conversion mediums and green light conversion mediums, luminous efficacy of the second set of light sources 220 adopting phosphors is higher than that of the first set of light sources 610*a* adopting quantum dot components, but gamut of the second set of light sources 220 adopting phosphors is smaller than that of the first set of light sources 610*a* adopting quantum dot components.

Based on the above, the image adjusting method, the light source module, and the electronic device of embodiments of the invention adjust the driving intensity corresponding to the first set of light sources and the second set of light sources respectively according to different image modes, such that giving consideration to the quality of the image and luminous efficacy of the light source module both, further satisfying requirements of wide gamut and high color saturation of some images, and increasing luminous efficacy to prolong lifetime of products.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An image adjusting method, comprising:

driving a first set of light sources and a second set of light sources of a light source module independently by corresponding driving intensity respectively, wherein the first set of light sources includes a plurality of first white light LEDs, and the second set of light sources includes a plurality of second white light LEDs;

receiving an image display command;

adjusting the driving intensity corresponding to the first set of light sources and the second set of light sources respectively according to the image display command, wherein a gamut of the first set of light sources is wider than that of the second set of light sources, and luminous efficacy of the second set of light sources is higher than that of the first set of light sources;

determining a light emitting performance corresponding to the light source module according to a display situation, wherein the light emitting performance comprises at least one of output power, the luminous efficacy, and the gamut of the light source module;

determining a power ratio according to the light emitting performance, wherein the power ratio is a ratio of an output intensity of the first set of light sources versus that of the second set of light sources; and adjusting the driving intensity corresponding to the first set of light sources and the second set of light sources respectively by adjusting a magnitude of a current flowing through the first set of light sources and a magnitude of a current flowing through the second set of light sources according to the power ratio while keeping a sum of the magnitudes of the currents flowing through the first set of light sources and the second set of light sources as a constant.

2. The image adjusting method according to claim 1, wherein steps for adjusting the driving intensity corresponding to the first set of light sources and the second set of light sources respectively include turning off the first set of light sources and turning on the second set of light sources only.

3. The image adjusting method according to claim 1, wherein steps for adjusting the driving intensity corresponding to the first set of light sources and the second set of light sources include turning on both the first set of light sources and the second set of light sources.

4. The image adjusting method according to claim 1, further comprising changing a gamma curve of a display panel which adopts the light source module as a light source according to the image display command.

5. The image adjusting method according to claim 1, wherein the display situation includes a high efficiency mode and a wide gamut mode, the power ratio is decreased when the high efficiency mode is determined, and the power ratio is increased when the wide gamut is determined.

6. A light source module, comprising:

a first set of light sources;

a second set of light sources, wherein the first set of light sources includes a plurality of first white light LEDs, and the second set of light sources includes a plurality of second white light LEDs, wherein the first white light LEDs comprise a plurality of blue light diodes, red light conversion mediums, and green light conversion mediums, and the second white light LEDs comprise a plurality of blue light diodes and yellow light conversion mediums, and wherein a gamut of the first set of light sources is wider than that of the second set of light sources, and luminous efficacy of the second set of light sources is higher than that of the first set of light sources; and a processor, electrically connected with the first set of light sources and the second set of light sources, and configured to adjust driving intensity corresponding to the first set of light sources and the second set of light sources respectively according to an image display command at least by adjusting a magnitude of a current flowing through the first set of light sources and a magnitude of a current flowing through the second set of light sources according to a power ratio while keeping a sum of the magnitudes of the currents flowing through the first set of light sources and the second set of light sources as a constant.

7. The light source module according to claim 6, further comprising a first flexible printed circuit board, a second flexible printed circuit board, and a light guide plate, wherein the light guide plate has a first light-incident side and a second light-incident side that are relative to each other, the first white light LEDs and parts of the second white light LEDs are arranged on the first flexible printed circuit board, interlacing with each other, and located on the first light-incident side, and the others of the second white light LEDs are arranged on the second flexible printed circuit board and located on the second light-incident side.

8. The light source module according to claim 6, wherein each of the first white light LEDs comprises:

a red light phosphor, a green light phosphor, and a blue light LED chip; or a red light LED chip, a green light phosphor, and a blue light LED chip.

9. The light source module according to claim 6, wherein each of the second white light LEDs comprises:

a red light phosphor, a green light phosphor, and a blue light LED chip; or a YAG and a blue light LED chip.

10. The light source module according to claim 6, further comprising a red light quantum dot component and a green light quantum dot component, wherein the first set of light sources includes a plurality of blue light LED chips.

11. The light source module according to claim 6, further comprising a red light quantum dot component, wherein the first set of light sources includes a plurality of blue light LED chips and green light phosphors.

12. An electronic device, comprising:

a body; and the light source module as claimed in claim 6, configured in the body.

13. An electronic device, comprising:

a body; and the light source module as claimed in claim 7, configured in the body.

14. An electronic device, comprising:

a body; and the light source module as claimed in claim 8, configured in the body.

15. An electronic device, comprising:

a body; and the light source module as claimed in claim 9, configured in the body.

16. An electronic device, comprising:

a body; and the light source module as claimed in claim 10, configured in the body.

17. An electronic device, comprising:

a body; and the light source module as claimed in claim 11, configured in the body.

* * * * *